US011952893B2

(12) United States Patent
Vasconcelos Nabuco et al.

(10) Patent No.: US 11,952,893 B2
(45) Date of Patent: Apr. 9, 2024

(54) COMPACT PERIPHERAL UNIT FOR ONSHORE PRODUCTION RIGS

(71) Applicant: Petróleo Brasileiro S.A.—Petrobras, Rio de Janeiro (BR)

(72) Inventors: Picasso Fabricio Vasconcelos Nabuco, Salvador (BR); Daniel De Andrade Ivo, Aracaju (BR); Willian Rafael Freitas De Souza, Aracaju (BR)

(73) Assignee: Petróleo Brasiliero S. A.—Petrobras, Rio de Janeiro (BR)

( * ) Notice: Subject to any disclaimer, the term of this patent is extended or adjusted under 35 U.S.C. 154(b) by 0 days.

(21) Appl. No.: 17/787,071

(22) PCT Filed: Dec. 15, 2020

(86) PCT No.: PCT/BR2020/050547
§ 371 (c)(1),
(2) Date: Jun. 17, 2022

(87) PCT Pub. No.: WO2021/119785
PCT Pub. Date: Jun. 24, 2021

(65) Prior Publication Data

US 2023/0030154 A1 Feb. 2, 2023

(30) Foreign Application Priority Data

Dec. 20, 2019 (BR) ..... 10 2019 027602 9

(51) Int. Cl.
*E21B 7/02* (2006.01)

(52) U.S. Cl.
CPC ..... *E21B 7/02* (2013.01)

(58) Field of Classification Search
CPC ..... E21B 7/02–028
See application file for complete search history.

(56) References Cited

U.S. PATENT DOCUMENTS

| | | | | |
|---|---|---|---|---|
| 4,371,041 | A | 2/1983 | Becker et al. | |
| 4,493,382 | A | 1/1985 | Collins et al. | |
| 2005/0034869 | A1 | 2/2005 | Appleford et al. | |
| 2017/0138134 | A1* | 5/2017 | Walker | B01F 25/21 |
| 2020/0123863 | A1* | 4/2020 | Lindsay | E21B 19/165 |

FOREIGN PATENT DOCUMENTS

| | | | |
|---|---|---|---|
| CN | 202990852 | U | 6/2013 |
| WO | 2004031528 | A2 | 4/2004 |
| WO | 2021119785 | A1 | 6/2021 |

* cited by examiner

*Primary Examiner* — Kristyn A Hall
(74) *Attorney, Agent, or Firm* — Mintz, Levin, Cohn, Ferris, Glovsky and Popeo, P.C.

(57) ABSTRACT

The present invention relates to the optimization of the processes relating to the activities performed by Onshore Production Rigs simplified with the placing of loads on wheels. The use of the equipment on a single board, called a Compact Peripheral Unit (UCP), considerably reduces the quantity of loads moved in the rig dismounting, transport and mounting (DTM) process. As a result, in addition to optimizing the layout on leases, the DTM costs and time are reduced, together with the risk of accidents.

5 Claims, 5 Drawing Sheets

COMPACT PERIPHERAL UNIT FOR ONSHORE PRODUCTION RIGS

CROSS-REFERENCE TO RELATED APPLICATIONS

This application is a national phase application, filed under 35 U.S.C. § 371, of PCT International Patent Application No. PCT/BR2020/050547, filed Dec. 15, 2020, and claims benefit of and priority to Brazilian application BR 10 2019 027602 9, filed on Dec. 20, 2019, the disclosures of all of which are incorporated herein by reference in their entirety.

FIELD OF THE INVENTION

The present invention relates to the optimization of processes related to the activities performed by simplified Onshore Production Rigs.

DESCRIPTION OF THE STATE OF THE ART

The mature fields of the Sergipe Terra production asset are well known, some with more than 30 years of production. Its wells have characteristics of non-surge and impossibility of circulation. In this context, the proprietary Onshore Production Rigs (OPRs) operate under the Risks and Uncertainties Preliminary Analysis (RUPA) of simplified proprietary rigs. This RUPA includes the use of simplified Wellhead Safety Equipment (WHSE), consisting of a "blowout preventer" (BOP) blind drawer, BOP hollow drawer, production spool, BOP drive unit and lines, BOP remote drive panel, BOP rods and column safety valve) and that, if the well is in underbalance, the intervention should not be continued with a simplified OPR rig. In addition, interventions with the presence of hydrogen sulfide ($H_2S$), even at low concentrations, should be directed to conventional rigs. Before the invention, these simplified OPRs used some oversized equipment in their activities and, consequently, made unnecessary use of complex transport logistics.

WO 2004031528 A2 discloses a mobile drilling rig, including a rig mounted on swiveling floor supports. The drilling equipment is arranged on the rig and is operated by a power system that includes hydraulic pumps, a screw-type air compressor and a motor to drive the pumps and compressor. A transmission is common to both hydraulic pumps and the air compressor and includes an intersecting gear to transmit input power from the engine to the pumps and compressor. Compressed air from the compressor travels to an air reservoir in which the compressor oil is separated from the air. Compressor oil is routed from a gearbox oil inlet to a gearbox oil outlet which communicates with an air inlet on the compressor.

Document U.S. Pat. No. 4,493,382 A describes an "L" shaped slurry tank that has longitudinal and horizontal hinges on the upper edge of a wall panel to a part of the vehicle structure, or an extension thereof, such that, when lowered, it rests on the ground, horizontal position in relation to the hole to be drilled and, when raised, in a vertical load carrying position, where it is aligned with the adjacent side of the vehicle and its rear part is above the rear tire of the vehicle. A centrally located divider wall panel allows liquid to travel from the rear of the slurry tank to the front and then to the rear, where a removable extension for the slurry pump inlet pipe is located.

Document CN 202990852 U presents a compact onshore oil drilling machine comprising a main drilling machine, a slurry processing system and a control area which are arranged in sequence. The main drilling machine comprises a drilling machine base and a drilling turret. The slurry processing system comprises a plurality of rectangular slurry tanks which are arranged in parallel. The control area comprises a pump room, an energy area and an auxiliary tank room. The pump chamber, power area and auxiliary tank room are arranged in layered mode. The total length of the main drilling machine, slurry processing system and control area is less than 45 m. Compact onshore oil drilling rig has the advantages that due to the fact that the technical scheme is adopted, the footprint of the drilling machine is effectively reduced, the lengths of various pipelines and cables are greatly shortened, and the cost of drilling machine manufacturing is effectively reduced.

The present invention discloses a compact peripheral unit for onshore production rigs with placing loads on wheels and replacing a slurry pump (alternative pump normally driven by a diesel engine) by a centrifugal pump, different from what is disclosed by the documents from the state of the art.

BRIEF DESCRIPTION OF THE INVENTION

The Compact Peripheral Unit is basically composed of five pieces of equipment: BOP Drive Unit (1 and 2), Tool Skid (3), Fluid Tank (4), Fluid Pump (5) and WHSE Test Unit (6), and low board (7) that supports these equipments. It is used in onshore production rigs putting loads on wheels, in addition to replacing the conventional slurry pump with a centrifugal pump, considerably reducing the amount of loads moved in the dismounting, transport and mounting (DTM) process of the rigs.

BRIEF DESCRIPTION OF THE DRAWINGS

The detailed description presented below makes reference to the attached figures and their respective reference numbers, representing the embodiments of the present invention.

DETAILED DESCRIPTION OF THE INVENTION

Figure 1:
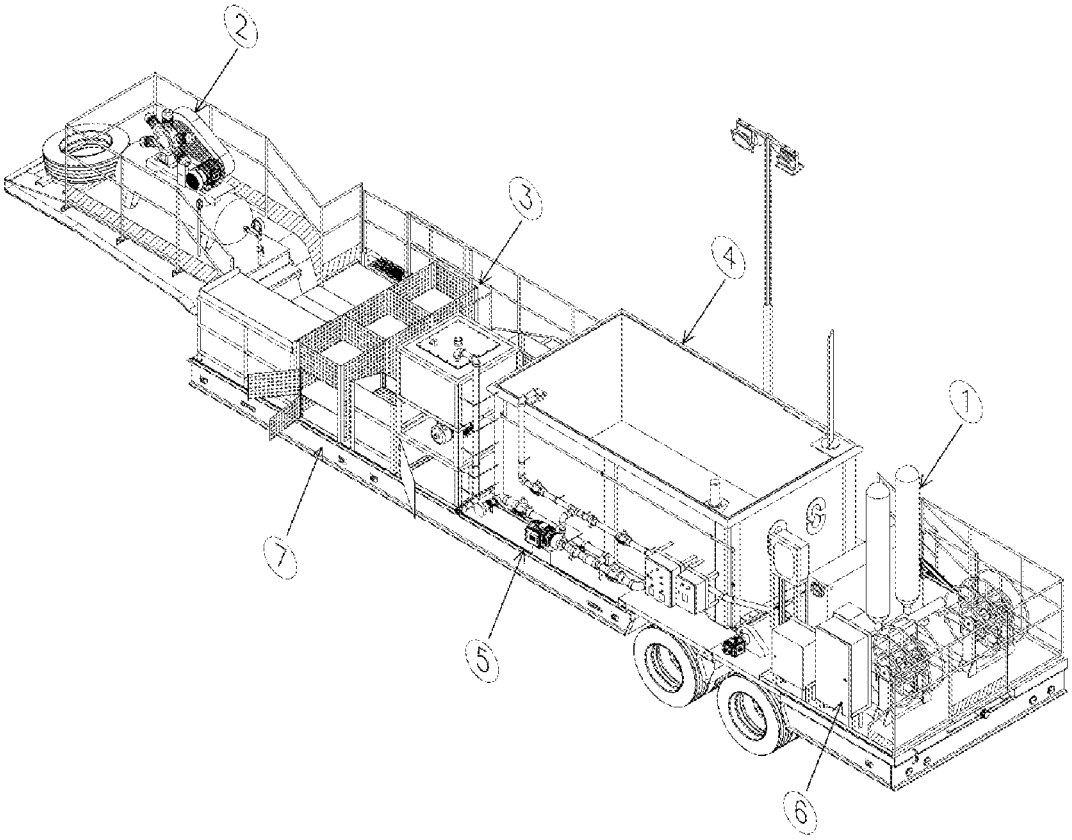
FIG. 1 illustrates a Compact Peripheral Unit for onshore production rigs, consisting of five main pieces of equipment: BOP drive unit, tool skid, fluid tank, fluid pump and WHSE test unit.
Figure 2:
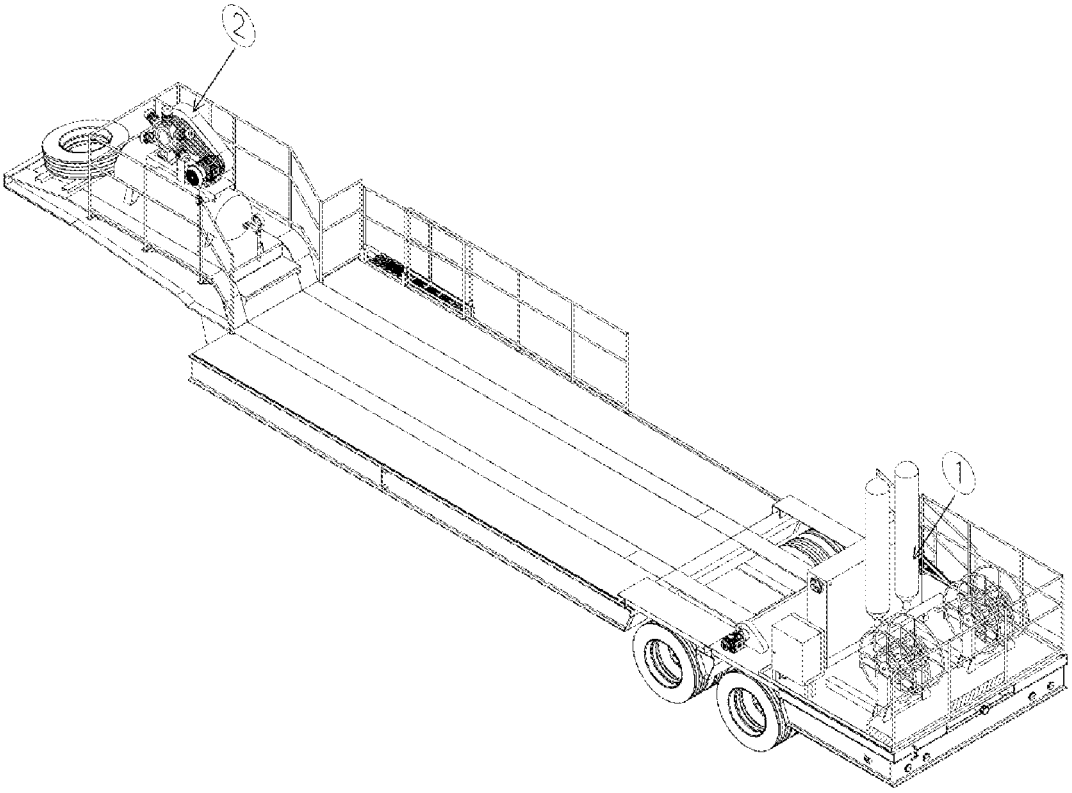
FIG. 2 illustrates the hydraulic unit that drives the BOP and its air compressor (items 1 and 2, respectively).
Figure 3:
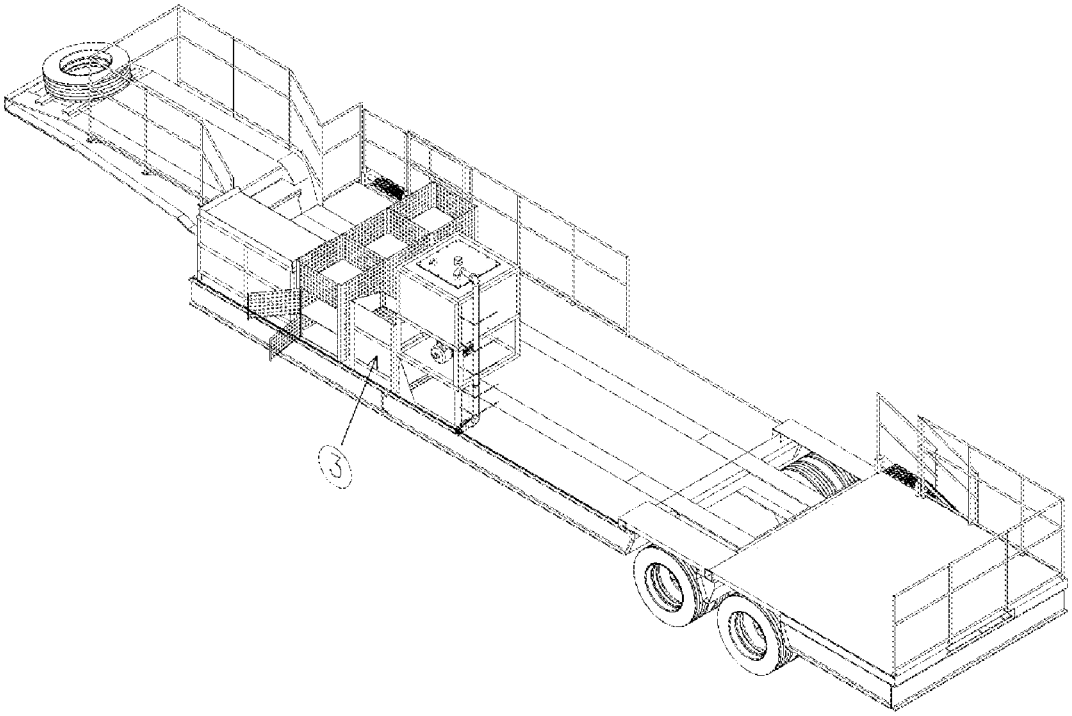
FIG. 3 illustrates the tool skid.
Figure 4:
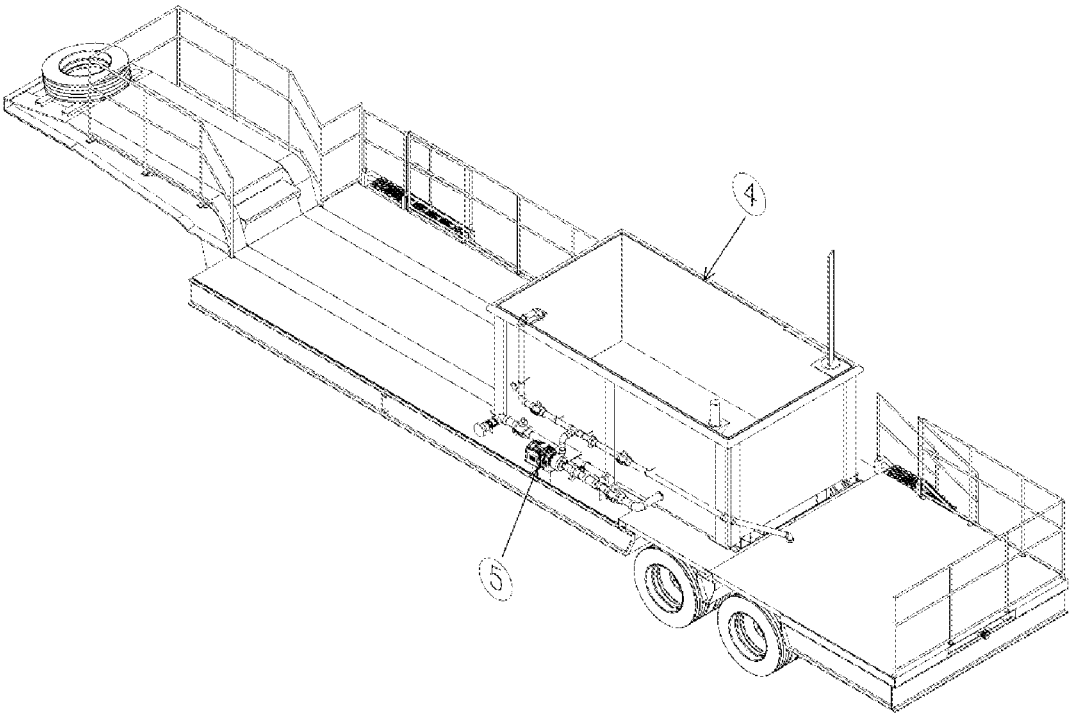
FIG. 4 illustrates the pump and the fluid tank.
Figure 5:
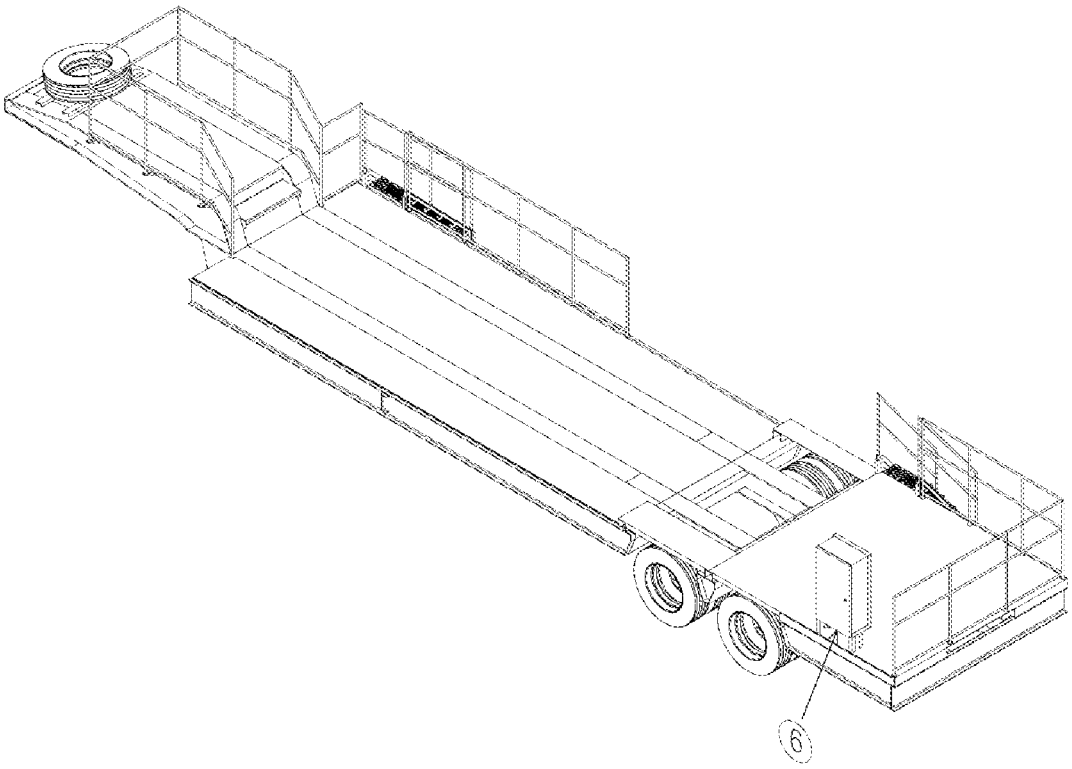
FIG. 5 illustrates the WHSE test unit.

The Compact Peripheral Unit is basically composed of the following components, as shown in FIG. 1: BOP Drive Hydraulic Unit (1), Compressed Air System (2), Tool Skid (3), Fluid Tank (4), Fluid Pump (5), WHSE Test Unit (6) and Board (7):

- Hydraulic BOP Drive Unit (1): equipment intended to supply the hydraulic energy needed to drive (open and close) the BOP drawers.
- Compressed air system (2): Comprises a radial compressor coupled to a compressed air vessel and pipes. It is responsible for generating, storing and supplying compressed air to drive a hydropneumatic pump of the BOP hydraulic drive unit (1) and WHSE test unit (6).
- Tool Skid (3): Intended for storing the operation's tools/utilities.

Fluid tank (4): is a tank of approximately 60 bbl intended for the storage of fluids to supply the well.

Fluid Pump (5): equipment designed to transfer fluid from the fluid tank to the well.

WHSE test unit (6): Equipment intended for the WHSE tightness test.

Board (7): structure intended for the installation of all the rig peripherals mentioned above, in addition to facilitating their road transport.

As the own OPRs operate in a simplified way, without fighting the well, it was identified that the only function of the slurry pump is to complete the well. The conventional slurry pump (alternative) was replaced by a centrifugal pump (5) with a flow rate equal to that of the conventional slurry pump (FIG. 7). For some specific operations (column testing, for example) that require pressure, the WHSE test unit (6) will be used.

The rig fluid is used only to complete the well, the operation team determined that a volume of 60 barrels would be more than enough for the rig operation, so the tank (4) was reduced to that volume.

The CPU hydraulic unit has not undergone any changes. The unit's layout was modified in relation to the routing of lines and the position of equipment in order to optimize space and leave the operator's area free.

The Compact Peripheral Unit CPU has greater accessibility for operators. With the exception of the BOP Hydraulic Drive Unit (BOPHDU), and Tool Skid (3), all other operations are performed from the ground.

The ratchets are flatbed trucks with a hydraulic system to pull and receive all equipment and skids. Currently, ratchets (FIG. 6) are used exclusively for the DTM of the rigs and 5 mechanical horses that meet the DTM of the rigs and fluid station. After the CPU's integration into the five rigs, 8 ratchets can be eliminated, keeping only two for handling rods and tubes boxes. The 5 mechanical horses already handle the movement of trailers and will also be able to handle the CPU's, without the need to increase the fleet.

The advantages of the proposed invention is that the number of rachets can be gradually reduced from 10 to 2, as the CPUs are being released for use, with a general cost reduction. Elimination of maintenance with slurry pumps, in addition to the consumption of diesel and lubricating oil; decrease in corrective maintenance on equipment, due to transport with ratchets. The interconnection of the BOP driver, which is in the CPU with the BOP, is made through hoses (a type of hose used to withstand greater pressure). These hoses are positioned at a fixed point in the CPU and before, their wear was greater, due to handling during movement. Thus, there is a reduction in expenses with rig hoses, which are now more frequently changed due to load movements and handling thereof at locations (reduction of 3 hoses per rig). Expectation of faster DTMs.

The invention claimed is:

1. A compact peripheral unit comprising:

a hydraulic unit to drive a BOP;

a compressed air system;

a tool skid;

a fluid tank;

a fluid pump;

a Wellhead Safety Equipment (WHSE) test unit; and a board supporting the hydraulic unit, the compressed air system, the tool skid, the fluid tank, the fluid pump, and the WHSE test unit simultaneously.

2. The compact peripheral unit according to claim 1, wherein the board is configured to receive an installation of and facilitate a road transport of the hydraulic unit, the compressed air system, the tool skid), the fluid tank), the fluid pump, the WHSE test unit), and an electrical system.

3. The compact peripheral unit according to claim 1, wherein the fluid pump comprises a centrifugal fluid pump.

4. The compact peripheral unit according to claim 1, wherein the fluid tank has a capacity of 60 barrels.

5. The compact peripheral unit according to claim 1, wherein the board further comprises wheels attached to and supporting the board.

* * * * *